US010135188B2

(12) United States Patent
Houry

(10) Patent No.: US 10,135,188 B2
(45) Date of Patent: Nov. 20, 2018

(54) ENCLOSURE ASSEMBLY FOR AN ELECTRICAL CONNECTOR AND SAME

(71) Applicant: Connecteurs Electriques Deutsch, Evreux (FR)

(72) Inventor: Laurent Houry, Le Roncenay-Authenay (FR)

(73) Assignee: Connecteurs Electriques Deutsch, Evreux (FR)

( * ) Notice: Subject to any disclaimer, the term of this patent is extended or adjusted under 35 U.S.C. 154(b) by 0 days.

(21) Appl. No.: 15/239,103

(22) Filed: Aug. 17, 2016

(65) Prior Publication Data

US 2016/0359272 A1 Dec. 8, 2016

Related U.S. Application Data

(63) Continuation of application No. PCT/EP2015/051997, filed on Jan. 30, 2015.

(30) Foreign Application Priority Data

Feb. 20, 2014 (EP) ..... 14155983

(51) Int. Cl.

| | |
|---|---|
| ***H01R 13/627*** | (2006.01) |
| ***H01R 13/639*** | (2006.01) |
| ***H01R 13/641*** | (2006.01) |
| ***H01R 13/502*** | (2006.01) |

(52) U.S. Cl.

CPC ..... *H01R 13/639* (2013.01); *H01R 13/502* (2013.01); *H01R 13/641* (2013.01); *H01R 13/6275* (2013.01)

(58) Field of Classification Search

CPC ..... H01R 13/6272; H01R 13/6273; H01R 13/6275; H01R 13/639; H01R 13/641

USPC ..... 439/352, 357, 358

See application file for complete search history.

(56) References Cited

U.S. PATENT DOCUMENTS

| | | | | |
|---|---|---|---|---|
| 5,120,255 A * | 6/1992 | Kouda | H01R 13/641 | 439/489 |
| 5,605,471 A * | 2/1997 | Plyler | H01R 13/641 | 439/352 |
| 5,720,623 A * | 2/1998 | Polenick | H01R 13/641 | 439/352 |
| 5,759,058 A * | 6/1998 | Childs | H01R 13/641 | 439/352 |
| 8,016,606 B1 * | 9/2011 | Kwan | H01R 13/641 | 439/352 |
| 8,678,846 B2 * | 3/2014 | Hitchcock | H01R 13/6272 | 439/352 |

OTHER PUBLICATIONS

PCT International Search Report and Written Opinion, dated Apr. 14, 2015, 7 pages.

European Search Report, dated Jul. 7, 2014, 5 pages.

* cited by examiner

*Primary Examiner* — Hien Vu

(74) *Attorney, Agent, or Firm* — Barley Snyder

(57) ABSTRACT

An enclosure assembly for an electrical connector is disclosed. The enclosure assembly comprises a housing body having a catch securing the housing body to a portion of the electrical connector and a lock. The lock is movable between an unlocking position and a locking position in which the lock prevents movement of the catch, and pivotable from the locking position into a secured position preventing movement of the lock back to the unlocking position.

17 Claims, 12 Drawing Sheets

ENCLOSURE ASSEMBLY FOR AN ELECTRICAL CONNECTOR AND SAME

CROSS-REFERENCE TO RELATED APPLICATIONS

This application is a continuation of PCT International Application No. PCT/EP2015/051997, filed Jan. 30, 2015 which claims priority under 35 U.S.C. § 119 to European Patent Application No. 14155983.1, filed Feb. 20, 2014.

FIELD OF THE INVENTION

The present invention relates to an enclosure assembly, and more particularly, to an enclosure assembly for an electrical connector.

BACKGROUND

Known enclosure assemblies for electrical connectors are used to surround electrical components, protecting them against detrimental environmental influences such as shock, dirt, and moisture. The enclosure assemblies have housings providing an interior space for accommodating the electrical components. In order to mount and access the electrical components within the interior space, some enclosure assemblies have multiple housings, and other enclosure assemblies are formed by the respective housings of a plug and a mating plug. The known housings are held together by catches on one housing interacting with respective counter-catches on the other housing.

The catches and counter-catches may be held in a locking position by a locking element in order to prevent unintended detachment. Screws are often used as the locking element, and may be screwed into a securing element having the catch. For example, a known connector 101 with an enclosure assembly 102 having a locking mechanism 110 with a catch 115*a* is shown in FIG. 9. The catch 115*a* engages a counter-catch 115*b* and is held in a latched state by a screw 120. The screw 120 is screwed into a securing element 136 formed of metal to secure a first housing body 103*a* to a second housing body 103*b*.

Manufacturing the screw and the securing element used in the known prior art, however, is expensive. Further, using a screw necessitates the use of a device to tighten and remove the screw, and checking a correct tightening of the screw may require dynamometric tools. These additional steps and required parts make the manufacture and assembly of known enclosure assemblies cumbersome and expensive. Furthermore, parts may be lost during assembly or service, risking an unintended disconnection. The screw 120, as shown in FIG. 9, may also interfere with electrical components 108 within an interior 104 of the enclosure assembly 102.

SUMMARY

An object of the invention, among others, is to provide an enclosure assembly which is easy to manufacture and assemble while providing a high level of protection against environmental influences. The disclosed enclosure assembly comprises a housing body having a catch securing the housing body to a portion of the electrical connector and a lock. The lock is movable between an unlocking position and a locking position in which the lock prevents movement of the catch, and pivotable from the locking position into a secured position preventing movement of the lock back to the unlocking position.

BRIEF DESCRIPTION OF THE DRAWINGS

The invention will now be described by way of example with reference to the accompanying figures, of which.

DETAILED DESCRIPTION OF THE EMBODIMENT(S)

The invention is explained in greater detail below with reference to embodiments of an enclosure assembly for an electrical connector. This invention may, however, be embodied in many different forms, and should not be construed as limited to the embodiments set forth herein; rather, these embodiments are provided so that this disclosure will be thorough and complete and still fully convey the scope of the invention to those skilled in the art.

Figure 1:
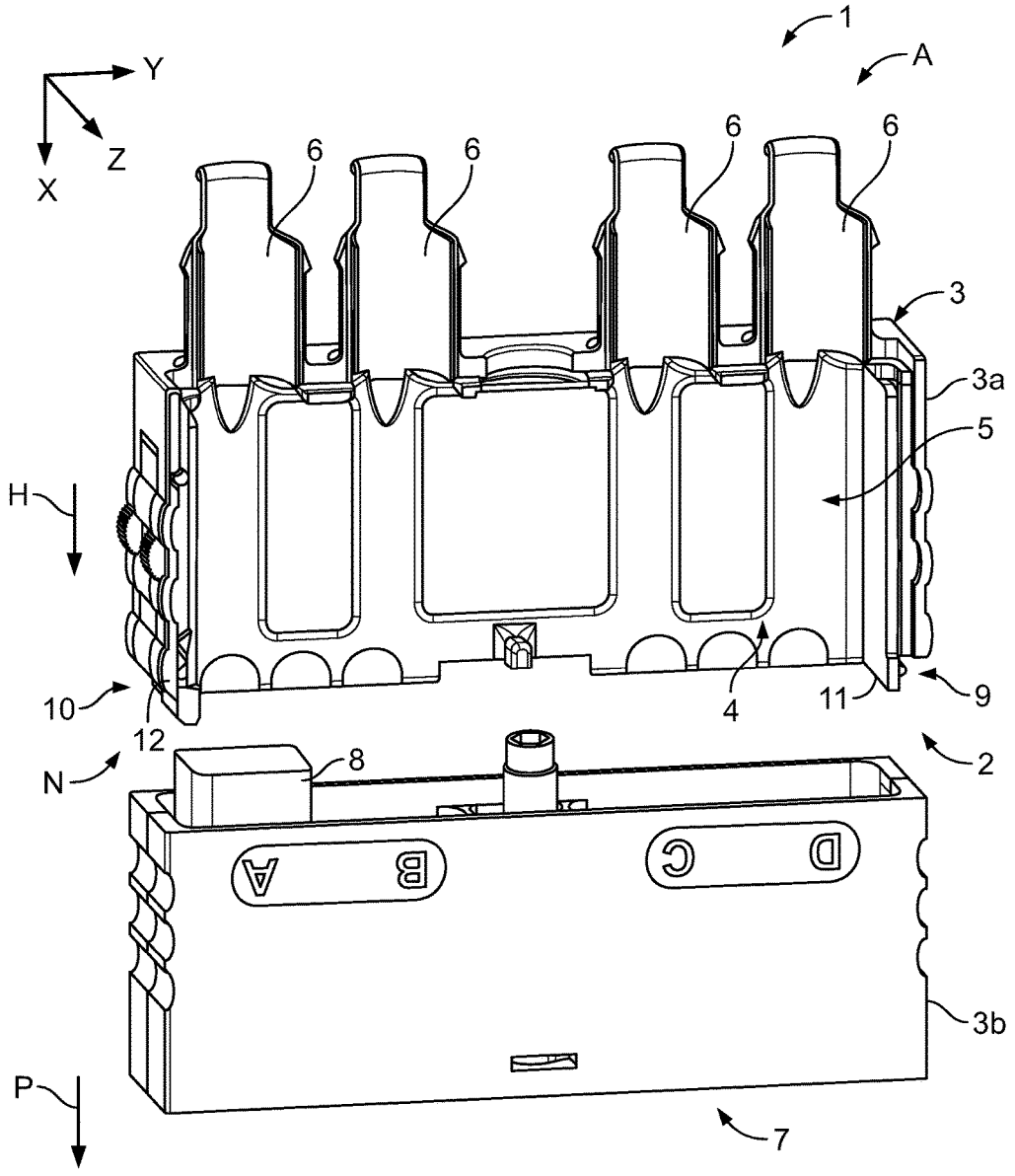
FIG. 1 is a perspective view of an electrical connector having an enclosure assembly according to the present invention.

An enclosure assembly 2 for an electrical connector 1 is shown generally in FIG. 1. The electrical connector 1 including an embodiment of the enclosure assembly 2 according to the invention will be first described with reference to FIG. 1, which shows the electrical connector 1 with the enclosure assembly 2 in an unassembled state A.

A longitudinal direction X, a transverse direction Y and a height direction Z may be assigned to the connector 1 and/or the enclosure assembly 2 in FIG. 1. The longitudinal direction X, the transverse direction Y and the height direction Z extend perpendicularly with respect to each other such that they may be regarded as constituting a Cartesian coordinate system. All mentions of a front or rear side or in front or in rear of elements or parts of the connector 1 and/or the enclosure assembly 2 may be associated with the longitudinal direction X. All mentions of a left or right side may be associated with the transverse direction Y. All mentions of an upper or lower side or above or below may be associated with the height direction Z.

Figure 7:
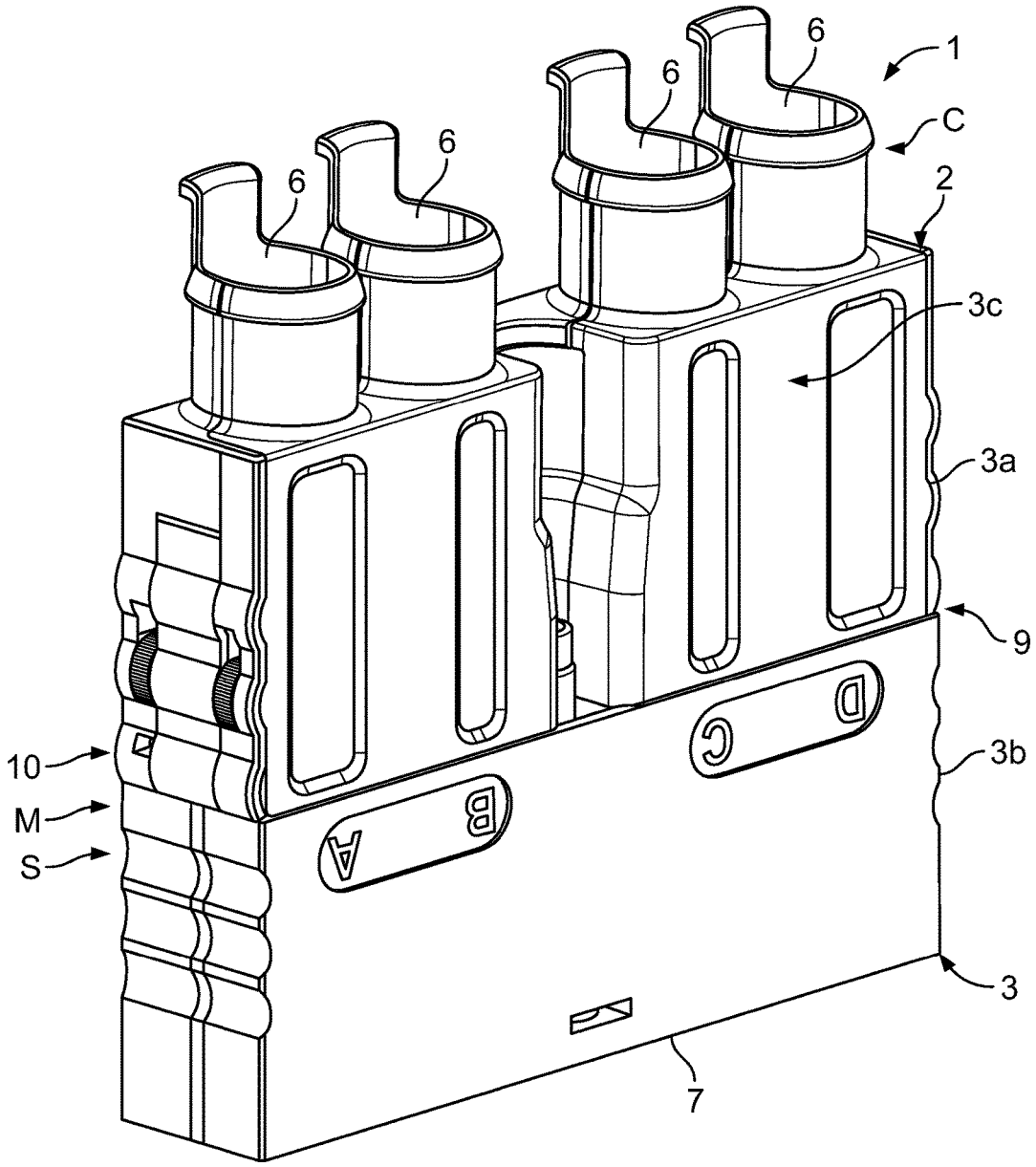
FIG. 7 is a perspective view of the enclosure assembly of FIG. 1 in a fully assembled state.

The enclosure assembly 2 includes a housing 3 having a first housing body 3*a*, a second housing body 3*b*, and a lid 3*c* shown in FIG. 7. An interior space 4 of the housing 3 is accessed through an access opening 5 which may be closed by the lid 3*c*. The housing 3 has at least one cable inlet 6 for leading electrical cables (not shown) from outside of the housing 3 into the interior space 4. The cable inlets 6 may be formed at the first housing body 3*a* or may be provided as one or more separate pieces to be mounted at the first housing body 3*a* separately or in groups.

The second housing body 3*b* may be a part of the housing 3, or may alternatively be another portion of the connector 1 such as a plug portion 7 of the connector 1. The plug portion 7 is adapted to be mated with a mating plug (not shown) of the connector 1 in a plug direction P running essentially in parallel in the longitudinal direction X. In a further alternative, the second housing body 3*b* may be a portion of a mating connector plug. The first housing body 3*a* and the second housing body 3*b* may thus be part of a single plug portion 7 or may be a plug portion 7 and a mating plug portion. The plug portion 7 may be formed by injection molding from plastic material.

The housing 3 may accommodate electrical components 8 such as, for example, terminals, filters, integrated circuits or other electric or electronic devices known to those with ordinary skill in the art. The interior space 4 may be shaped according to the respective requirements for taking up electrical components 8.

The enclosure assembly 2 also has an engaging mechanism 9 and a locking mechanism 10 in order to mechanically connect the first housing body 3*a* to the second housing body 3*b*. Engaging mechanisms 9 and locking mechanisms 10 may be provided in whatever number and form desired for connecting the first housing body 3*a* to the second housing body 3*b*. The engaging mechanism 9 may also be omitted and replaced by another locking mechanism 10.

In the embodiment shown in FIG. 1, the engaging mechanism 9 is fixed on a first wall portion 11 of the housing 3, in particular on a right wall portion. The locking mechanism 10 is disposed on a second wall portion 12 of the housing 3, in particular on a left wall portion. The first wall portion 11 and the second wall portion 12 oppose each other in the transverse direction Y with respect to the interior space 4.

In the unassembled state A shown in FIG. 1, the first housing body 3*a* and the second housing body 3*b* are separated from each other. The first housing body 3*a* may be engaged with the second housing body 3*b* by moving the first housing body 3*a* in an assembly direction H running essentially in parallel to the longitudinal direction X towards the second housing body 3*b*, subsequently engaging the engaging mechanism 9 and the locking mechanism 10 formed on the first housing body 3*a* and the second housing body 3*b* with each other.

Figure 2:
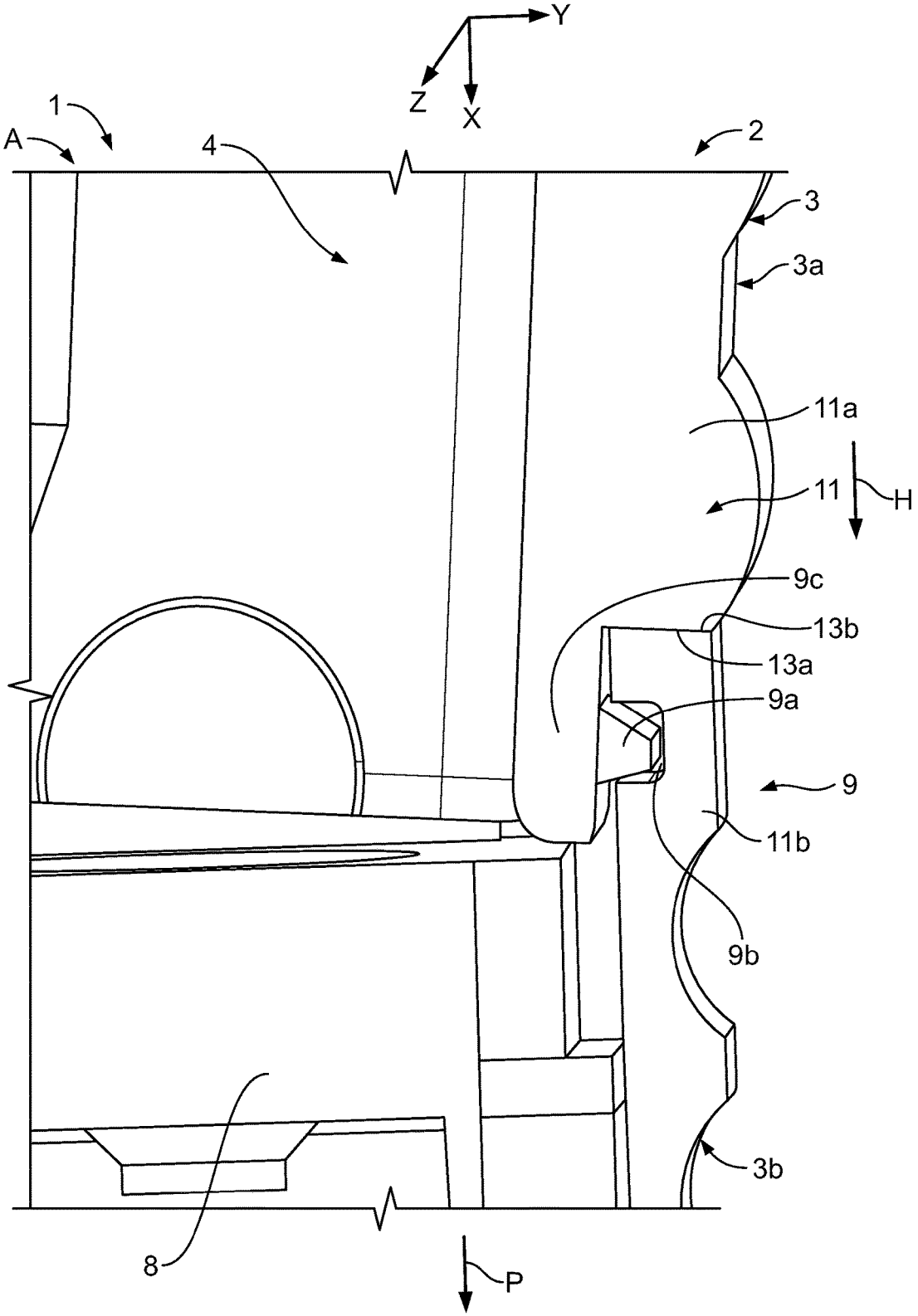
FIG. 2 is a detailed front view of a first side of the enclosure assembly of FIG. 1.

FIG. 2 shows the engaging mechanism 9 in detail while transferring the enclosure assembly 2 from the unassembled state A into a pre-assembled state B.

The first housing body 3*a* is placed on the second housing body 3*b* in the region of the first wall portion 11 in such a way that an upper first wall portion 11*a* of the first housing body 3*a* abuts a lower first wall portion 11*b* of the second housing body 3*b*. An upper first rim 13*a* formed at the upper first wall portion 11*a* facing the longitudinal direction X abuts a lower first rim 13*b* formed at the lower first wall portion 11*b* facing counter to the longitudinal direction X. The upper first wall portion 11*a* and the lower first wall portion 11*b* are part of the first wall portion 11 or, at least in sections, constitute the first wall portion 11.

The engaging mechanism 9 has an engaging protrusion 9*a* and an engaging recess 9*b*. The engaging protrusion 9*a* protrudes from the upper first wall portion 11*a*, in particular on an extension 9*c* protruding from the upper first wall portion 11*a* in the longitudinal direction X. The engaging protrusion 9*a* protrudes from the extension 9*c* in the transverse direction Y, and is positioned to extend into the engaging recess 9*b*.

The engaging protrusion 9*a* snugly engages the engaging recess 9*b* while the upper first rim 13*a* abuts the lower first rim 13*b*. The engaging mechanism 9 thus inhibits movement of the first housing body 3*a* with respect to the second housing body 3*b* in the region of the first wall portion 11, particularly preventing movement essentially parallel to the longitudinal direction X.

Figure 3:
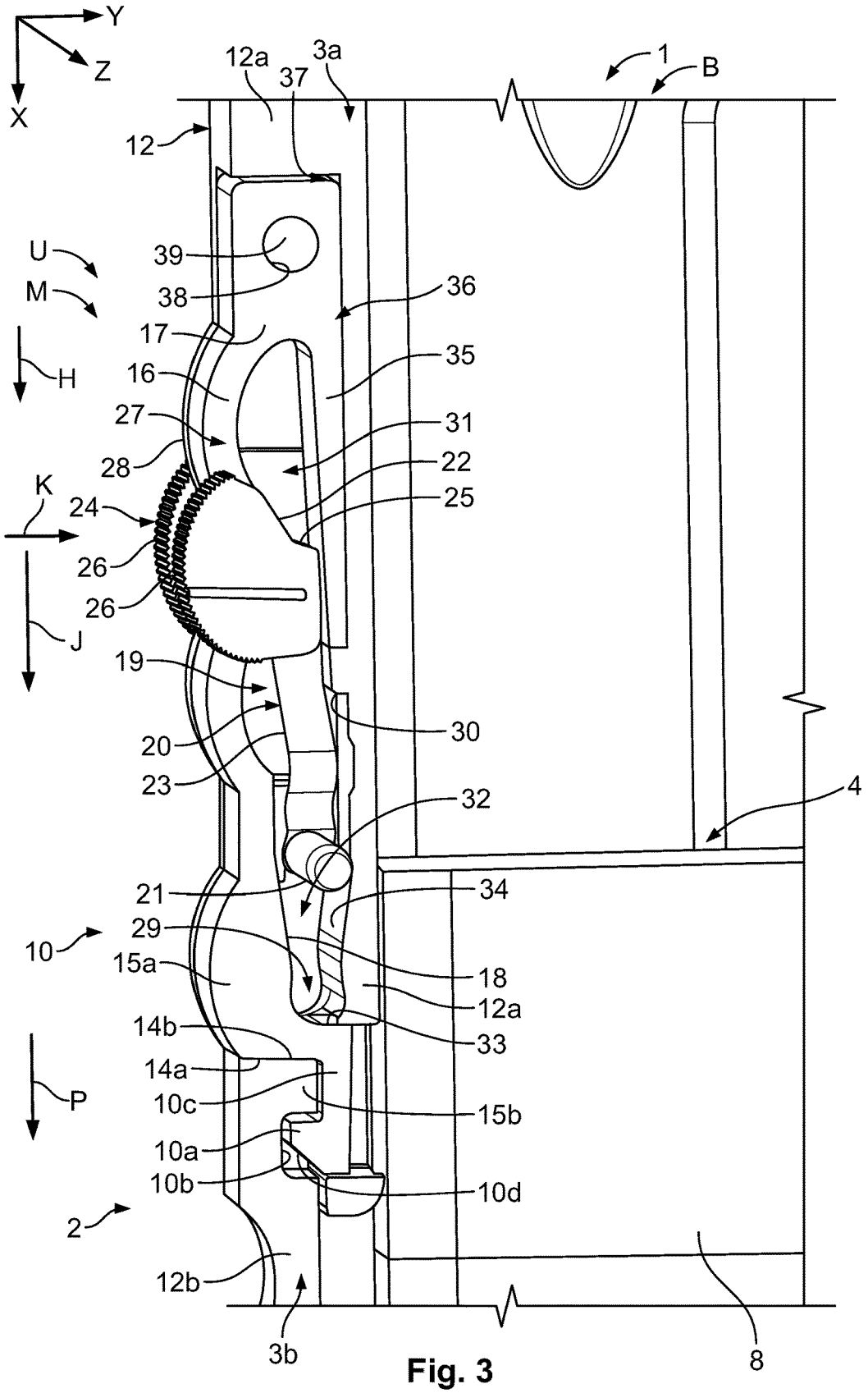
FIG. 3 is a detailed front view of a second side of the enclosure assembly of FIG. 1.

FIG. 3 shows the locking mechanism 10 in detail in a latched state M and unlocked position U.

The locking mechanism 10 includes a latching protrusion 10*a*, a latching recess 10*b*, and a latching arm 10*c*. The latching protrusion 10*a* is formed protruding from the latching arm 10*c*, which extends from the first housing body 3*a*, in particular from the upper second wall portion 12*a*. The latching protrusion 10*a* protrudes from the latching arm 10*c* counter to the transverse direction Y and is positioned to extend into the latching recess 10*b* formed in the lower second wall portion 12*b*. The latching recess 10*b* opens in the transverse direction Y towards the interior space 4. The engaging protrusion 9*a*, engaging recess 9*b*, latching protrusion 10*a*, and latching recess 10*b* may have a variety of complementary shapes; the protrusions and recesses may be reversed on the housing 3.

In the latched state M, an upper second rim 14*a* of the upper second wall portion 12*a* abuts a lower second rim 14*b* of the lower second wall portion 12*b*. In order to facilitate a deflection of the latching protrusion 10*a* in the transverse direction Y when moving the latching protrusion 10*a* past the upper second rim 14*a*, in a transition from an unlatched state N to the latched state M shown in FIG. 3, the latching element 10*b* has a bevel 10*d* facing in the longitudinal direction X and counter to the transverse direction Y in a slanted manner.

The latching protrusion 10*a*, the latching arm 10*c*, and the upper second rim 14*a* form a catch 15*a*. The catch 15*a* also has a leg 16 extending away from a base 17 of the locking mechanism 10. The leg 16 includes a first wall 18 of a lock passageway 19, within which a lock 20 of the locking mechanism 10 is disposed. The catch 15*a* and the lock 20 may be manufactured of plastic material, for example, by injection molding. A counter-catch 15*b* comprises the latching recess 10*b* and the lower second rim 14*b*.

Figure 3A:
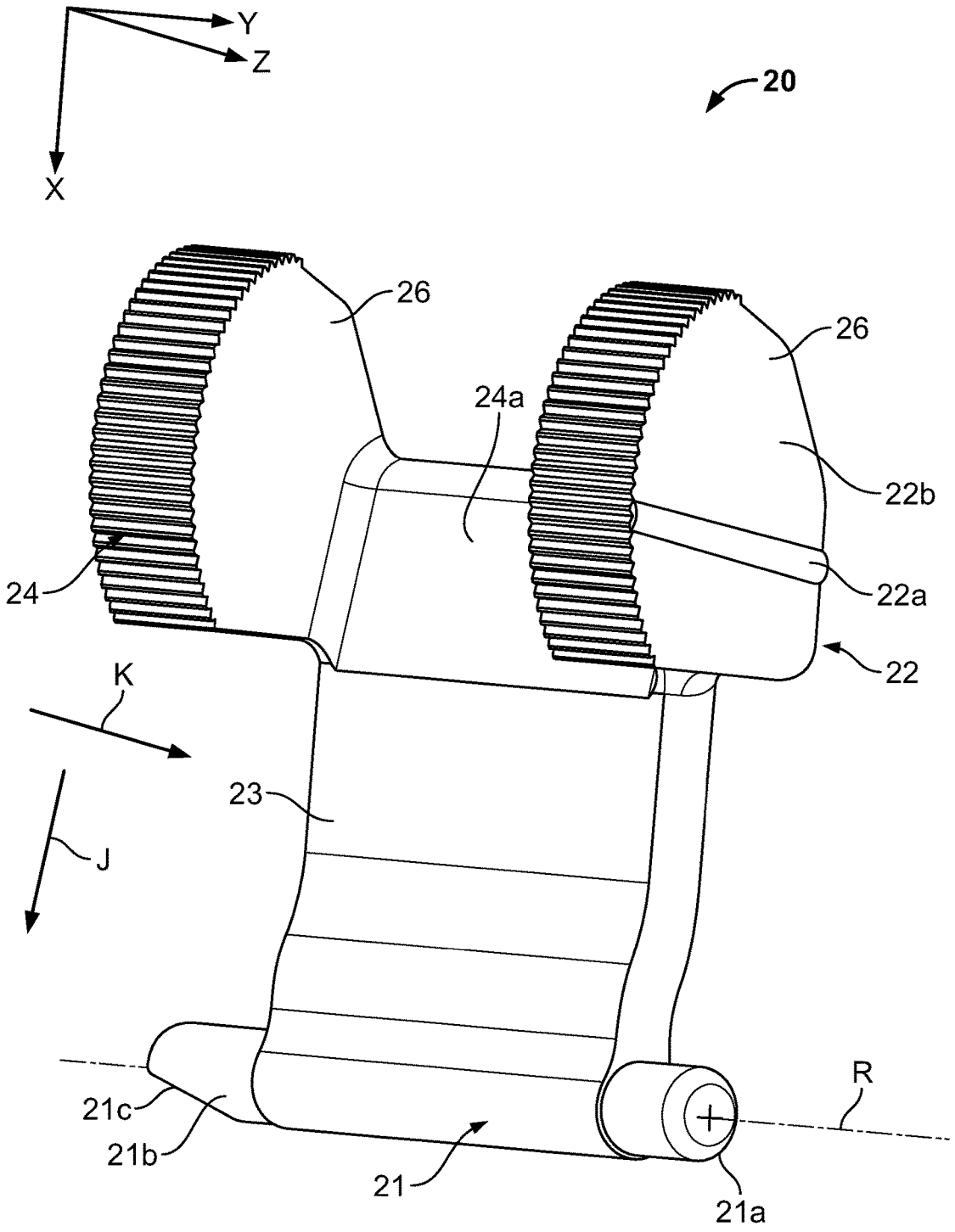
FIG. 3*a* is a perspective view of a lock of the enclosure assembly of FIG. 1.

The lock 20, as shown in FIGS. 3 and 3*a*, includes a post 21, an actuating section 22 and a spring 23 resiliently connecting the post 21 to the actuating section 22.

The post 21 protrudes from the lower end of the spring 23, which extends downwardly from the actuation section 22. As shown in FIG. 3*a*, the post 21 has a first hinge member 21*a* and a second hinge member 21*b*. The first hinge member 21*a* and the second hinge member 21*b* protrude laterally from the post 21 in a direction in or opposite to the height direction Z. The first hinge member 21*a* and the second hinge member 21*b* are formed as bosses or studs in the shown embodiment and define a rotational axis R of the lock 20. The first hinge member 21*a* has an essentially cylindrical shape with the rotational axis R running concentrically through it. The second hinge member 21*b* has an asymmetric shape with an insertion contour 21*c*. The insertion contour 21*c* may be formed as a bevel as shown herein and facilitates inserting the lock 20 into the lock passageway 19 in a predefined orientation.

The actuation section 22 includes a handle 24 and an arresting member 25. The handle 24 has two handling members 26 protruding in the direction opposite to the transverse direction Y and a connecting section 24*a* connecting the two handling members 26. The spring 23 may be arranged essentially in between the two handling members 26.

The actuation section 22 further includes a plurality of actuation openings 27 open to an exterior of the enclosure assembly 2. The handling members 26 extend through the actuation openings 27 adjacent an outer contour 28 of the enclosure assembly 2, so that the lock 20 may be accessed and operated from outside the enclosure assembly 2. As shown in FIG. 3*a*, the actuation section 22 also has a fixing member 22*a* arranged at a side face 22*b* of the lock 20. The fixing member 22*a* protrudes laterally from the side face 22*b* in the height direction Z and extends essentially perpendicularly to the actuation direction J along the transverse direction Y.

Figure 3B:
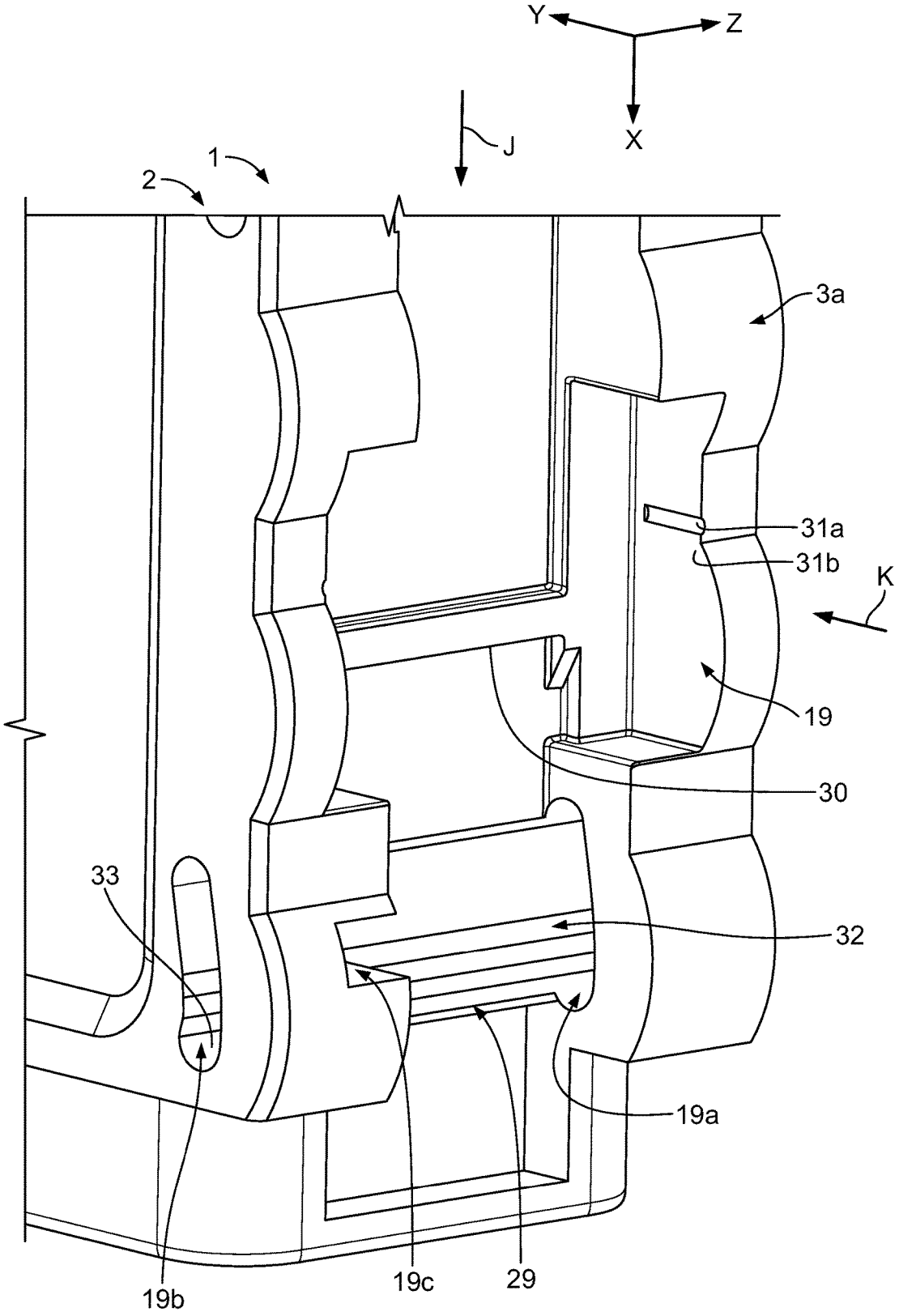
FIG. 3*b* is a perspective view of a lock passageway of the enclosure assembly of FIG. 1.

The lock passageway 19 is shown in FIGS. 3 and 3*b*. The lock passageway 19 has an upper guidance section 31 and a lower guidance section 32. The first wall 18 of the lock passageway 19 as well as a bottom 33 of the lock passageway 19, facing essentially against the actuation direction J, are formed at the catch 15*a*. In the lower guidance section 32, a second wall 34 of the lock passageway 19 is formed at the upper second wall portion 12*a* of the housing 3. In the upper guidance section 31, the second wall 34 of the lock passageway 19 is formed at a bar 35.

The bar 35, the leg 16 of the catch 15*a* and the base 17 may be formed as parts of an insert 36 received within a seating 37 which may be formed at the housing 3, in particular at the first housing body 3*a*. The insert 36 may be provided with a mounting element 38 for mounting the insert 36 to the housing 3. The insert 36 may include the upper second rim 14*a*, the catch 15*a*, the leg 16, the base 17, the first wall 18, the actuation opening 27, the outer contour 28, the bottom 33 of the lock passageway 19, the bar 35 and mounting element 38. The catch 15*a* may alternatively be integrally formed with the first housing body 3*a*. A mounting member 39 may be formed at the housing 3 or may be provided as a separate piece for interacting with the mounting element 38 of the insert 36, such that the insert 36 may be connected to the housing 3 in a positive fit and/or friction fit manner. The mounting element 38 may be a through-hole for example and the mounting member 39 may be formed as a boss and/or bolt to be fitted in the through-hole. The leg 16 and the bar 35 may be connected to each other via the base 17, which may serve as a yoke for holding the catch 15*a* so that it is resiliently connected to the first housing body 3*a*.

The lock passageway 19, as shown in FIG. 3*b*, also has a first counter hinge member 19*a* and a second counter hinge member 19*b* which are at least partially formed complementary to the first hinge member 21*a* and the second hinge member 21*b*, respectively, of the lock 20. The first counter hinge member 19*a* and the second counter hinge 19*b* may be formed as slots as shown herein, in order to receive the first hinge member 21*a* and the second hinge member 21*b*. In the region of the lower guidance section 32, the counter hinge members 19*a*, 19*b* may help to predefine the actuation direction J of the lock 20 in that they guide the hinge members 21*a*, 21*b* along a predefined trajectory which may be linear or slightly curved as shown in FIG. 3*b*. The counter hinge members 19*a*, 19*b* are rounded and form the bottom 33 of the lock passageway 19 in the region of the clamping section 29. The second counter hinge member 19*b* may be provided with a counter insertion contour 19*c*. The counter insertion contour 19*c* may be formed as an opening at least partially intersecting with the second counter hinge member 19*b* in the transverse direction Y so that the second hinge member 21*b* may be easily inserted into the further counter hinge member 19*b*, for example after first inserting the first hinge member 21*a* into the first counter hinge member 19.

The lock passageway 19 also has a counter fixing member 31*a*, as shown in FIG. 3*b*, positioned at a lateral section 31*b* of the lock passageway 19. The counter fixing member 31*a* is complementary to the fixing member 22*a* and may be formed as a pit, slot or groove extending essentially in parallel to the transverse direction Y and perpendicularly to the actuation direction J.

Figure 3C:
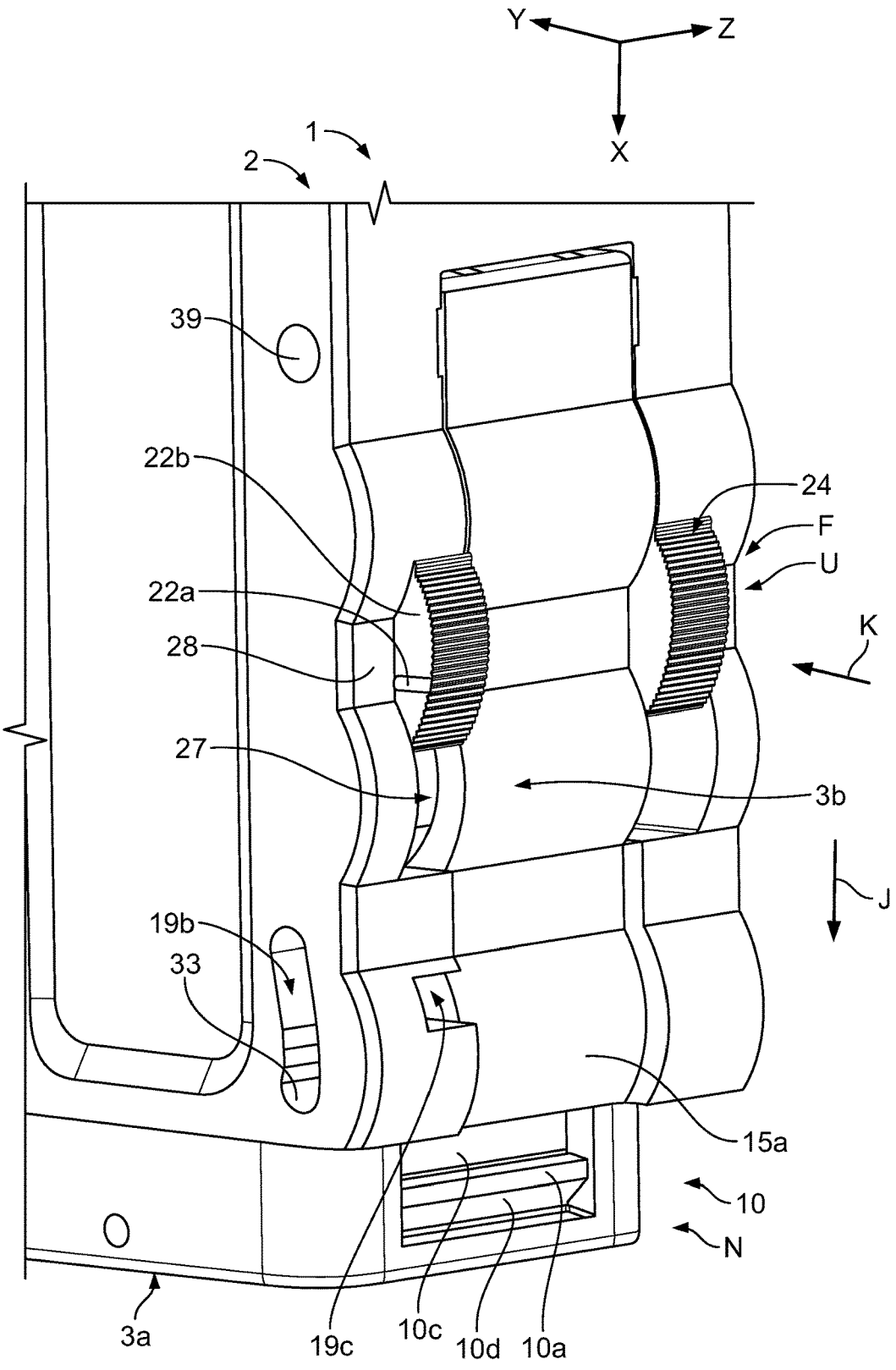
FIG. 3*c* is a perspective view of a locking mechanism of the enclosure assembly of FIG. 1 is an unlatched state and an unlocked position.

The enclosure assembly 2 is shown in FIG. 3*c* in the unlatched state N with the locking mechanism 10 in the unlocked position U. The lock 20 is in a fixed position F, wherein the fixing member 22*a* is engaged with the counter fixing member 31*a*, so that the lock 20 may be fixed in the unlocking position U in order to prevent an accidental or premature transferring of the locking mechanism 10 into the locked state L during handling the enclosure assembly 2.

The lock 20 may be slid along the lock passageway 19 in an actuation direction J running essentially in parallel to the longitudinal direction X and the assembly direction H. Further, the lock 20 may be swiveled and/or pivoted by exerting forces onto the handle 24 in a securing direction K running essentially in parallel to the transverse direction Y. By moving the lock 20 along the actuation direction J, the lock 20 can be transferred from the unlocking position U shown in FIG. 3 into a locking position L shown in FIG. 4 to immobilize the catch 15*a*.

Figure 4:
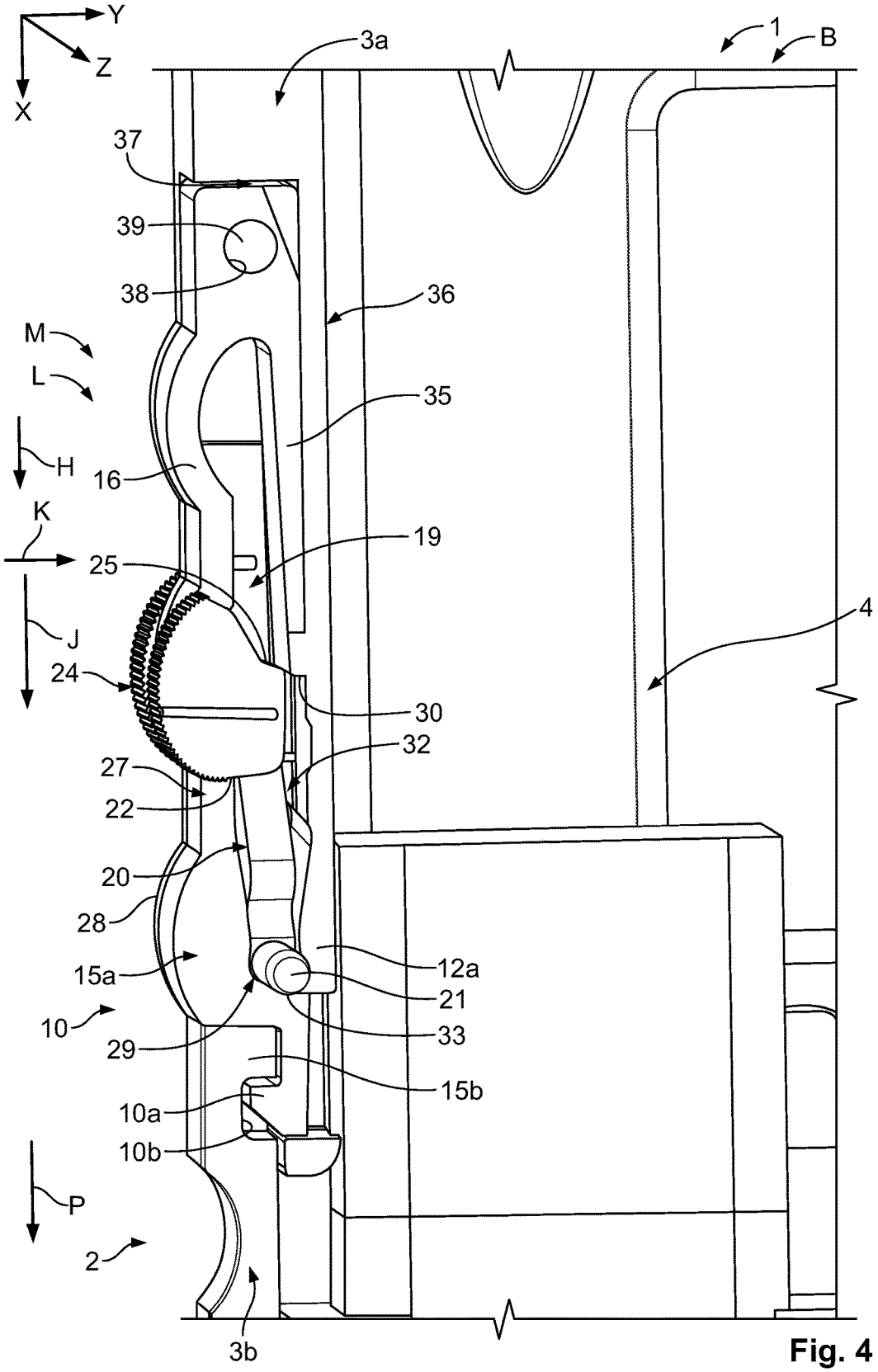
FIG. 4 is a perspective view of the locking mechanism of FIG. 3*c* in a latched state and a locked position.

FIG. 4 shows the enclosure assembly 2 in the pre-assembled state B with the locking mechanism 10 in the latched state M and locked position L. In the locked position L, the lock 20 is moved downwardly in the lock passageway 19 such that the post 21 is received in a clamping section 29 and abutting the bottom 33 of the lock receiving passageway 19. The clamping portion 29 of the lock passageway 19 may be formed essentially complementary to the post 21. When reaching the locking position L, the post 21 may snap into the clamping section 29 for giving audible, visual and/or tactile feedback to an operator assembling the enclosure assembly 2. In the locked position L, the post 21 is positioned between the upper second wall portion 12*a* and the catch 15*a*. Hence, the catch 15*a* cannot move out of or disengage from the counter-catch 15*b* in the transverse Y direction.

The lower guidance section 32 widens funnel-like from the bottom 33 upwardly so that the actuation section 22 may be pivoted about the post 21. By pushing on the handle 24 in the securing direction K shown in FIG. 4, the actuation section 22 can be pivoted about the post 21 until the arresting member 25 is brought into engagement with a stop 30 of the first housing body 3*a*, moving the locking mechanism 10 into a secured position S shown in FIG. 5.

Figure 5:
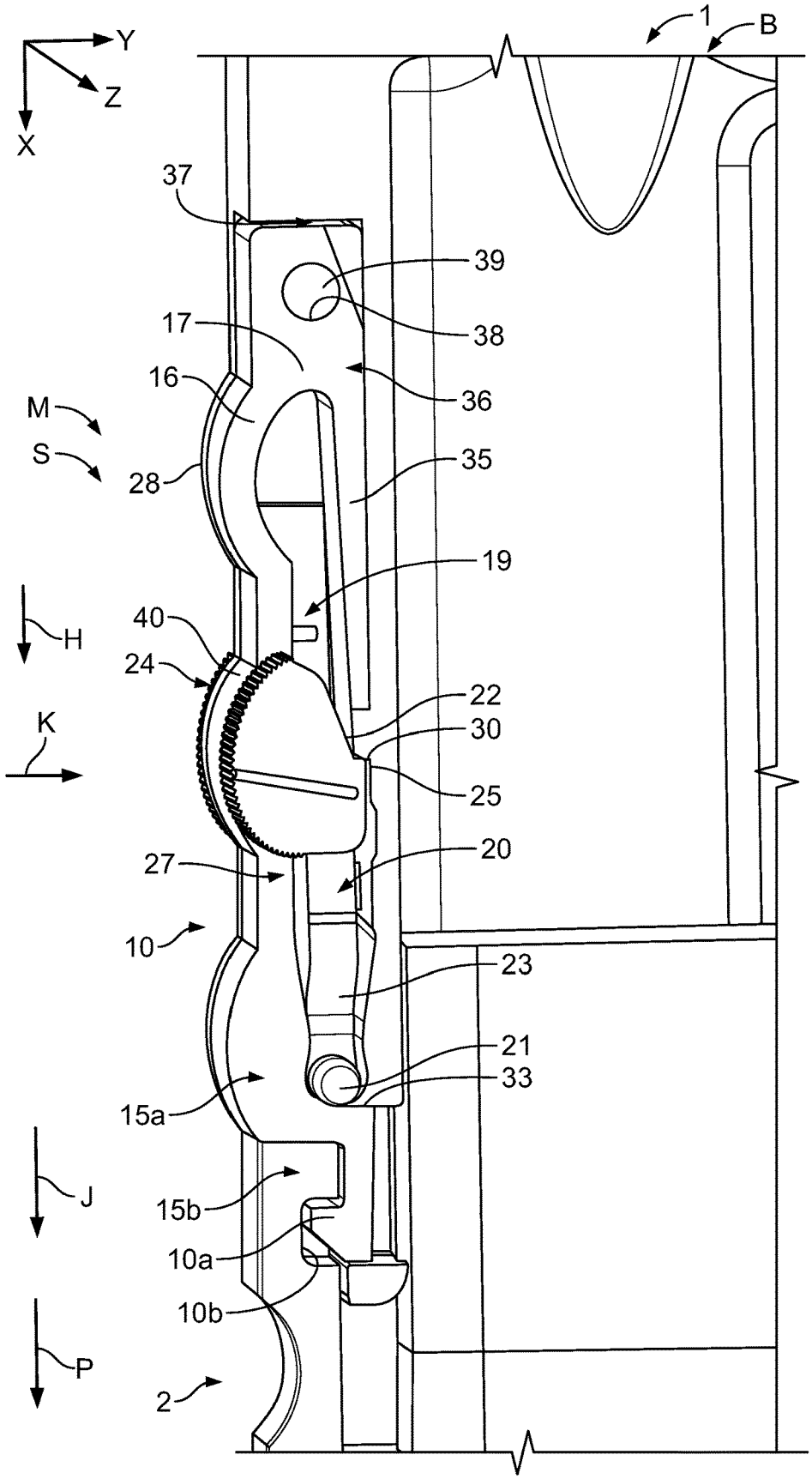
FIG. 5 is a perspective view of the locking mechanism of FIG. 3*c* in the latched state and a secured position.

FIG. 5 shows the enclosure assembly 2 in the pre-assembled state B with the locking mechanism 10 in the latched state M and the secured position S.

The lock 20 is moved from the locked position L to the secured position S by being moved in the securing direction K until the arresting member 25 is arrested and/or snapped in at the stop 30, which may cause an audible, visual and/or tactile feedback to an operator assembling the enclosure assembly 2. The lock 20 is positioned between the stop 30 and the bottom 33 of the lock passageway 19. The post 21 may be urged towards the catch 15*a* so that disengaging the catch 15*a* and the counter-catch 15*b* is further prevented. The spring 23 exerts spring forces such that the arresting member 25 snaps behind the stop 30 and a pressure is exerted onto the catch 15*a* against the transverse direction Y and/or onto the bottom 33 along the longitudinal direction X and actuation direction J. Thereby, the lock 20 can be fully jammed under spring tension in the secured position S.

The handle 24 in the secured position S is positioned within the actuation opening 27 and the outer contour of the handle 24 is aligned with the outer contour 28, such that the lock 20 is fully positioned within and does not protrude from the enclosure assembly 2. In particular, a bridge 40 formed at the leg 16 as a rounded buckle or curvature is adapted in shape to the contour of the handle 24 so that they are aligned with each other towards the outside of the enclosure assembly 2.

Figure 6:
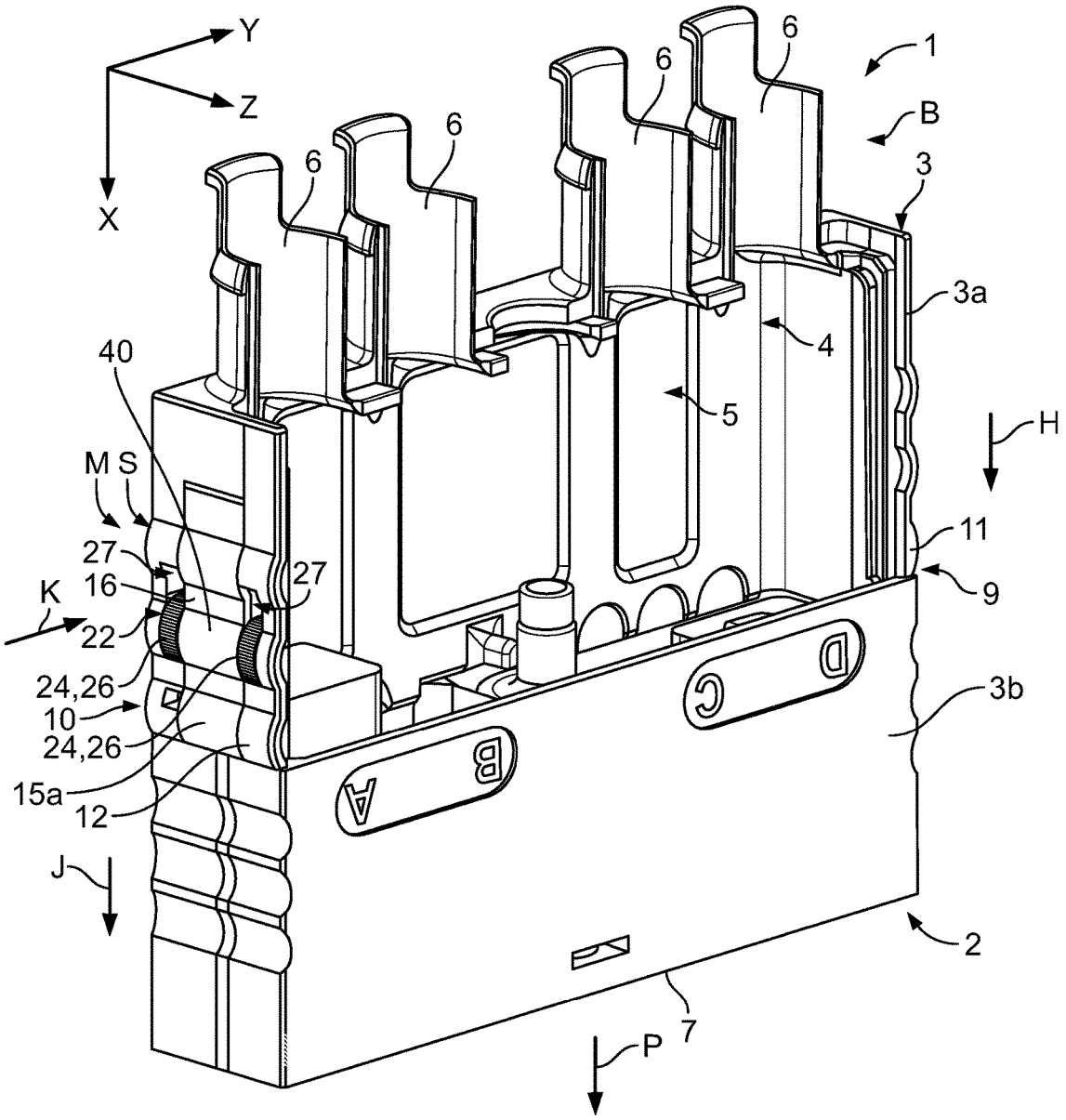
FIG. 6 is a perspective view of the enclosure assembly of FIG. 1 in a pre-assembled state.

FIG. 6 shows the connector 1 with the enclosure assembly 2 in the pre-assembled state B and latched state M with the locking mechanism 10 in the secured position S. In FIG. 6, the first housing body 3*a* is securely connected to the second housing body 3*b* by the engaging mechanism 9 on the first wall portion 11 and the locking mechanism 10 on the second wall portion 12, such that a disengagement counter to the assembly direction H is prevented. The interior 4 is still accessible through the access opening 5. The leg 16 is disposed between the handling members 26 in the region of the bridge 40.

FIG. 7 shows the electrical connector 1 with the enclosure assembly 2 in a fully assembled state C with the locking mechanism 10 in the latched state M and secured position S. In the fully assembled state C, the access opening 5 to the interior 4 of the enclosure assembly 2 is closed by the lid 3*c* while the locking mechanism 10 is still accessible from outside the enclosure assembly 2. As the lock 20 is fully positioned within the enclosure assembly 2, with the handling members 26 aligned with the outer contour 28, the lock 20 is protected against harmful environmental impacts such as shock, dirt, moisture, etc., and may further help in visually and/or manually checking that the secured position S is reached.

Figure 8:
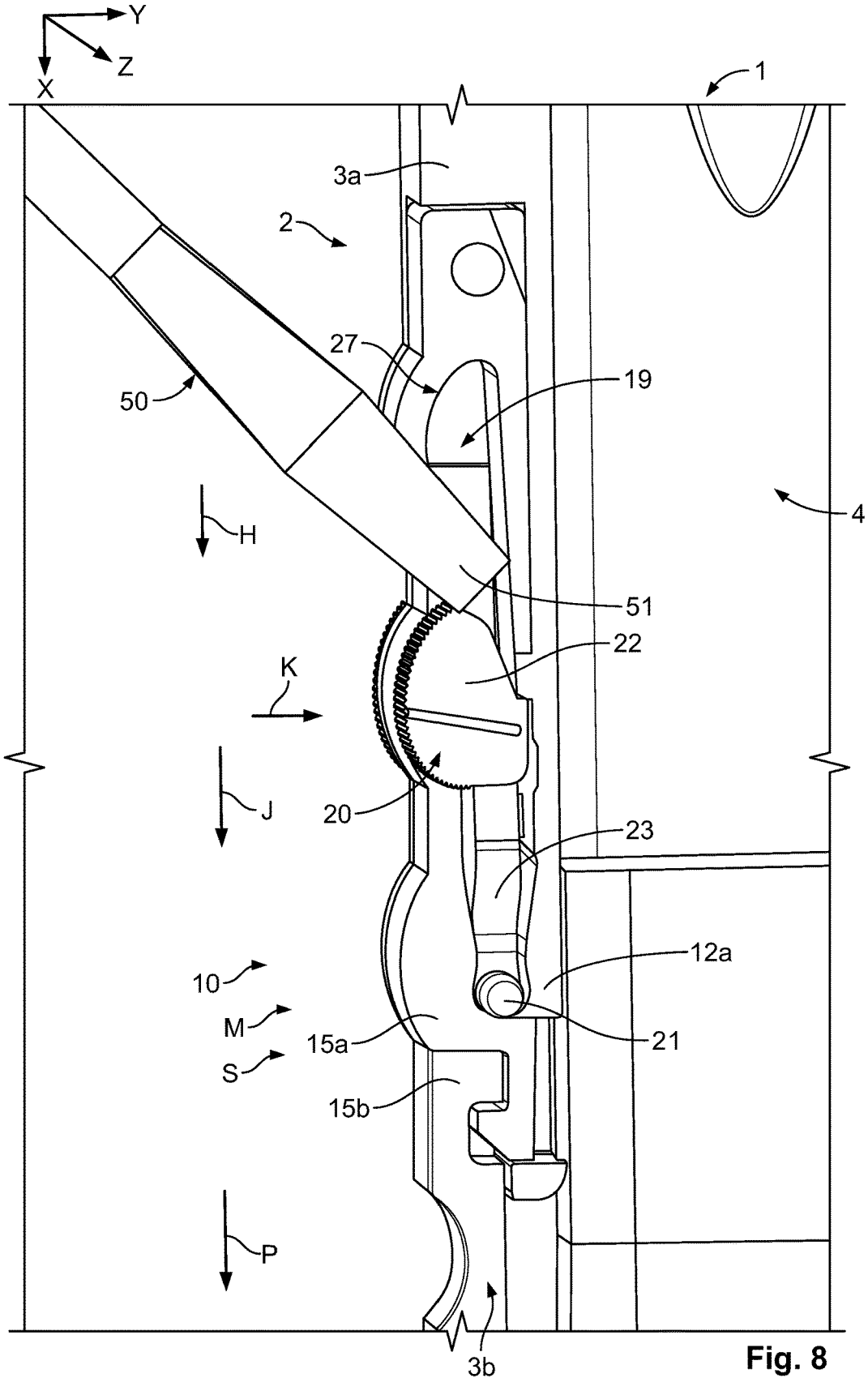
FIG. 8 is a detailed front view of a tool and the locking mechanism of FIG. 3*c* in a latched state and secured position.
Figure 9:
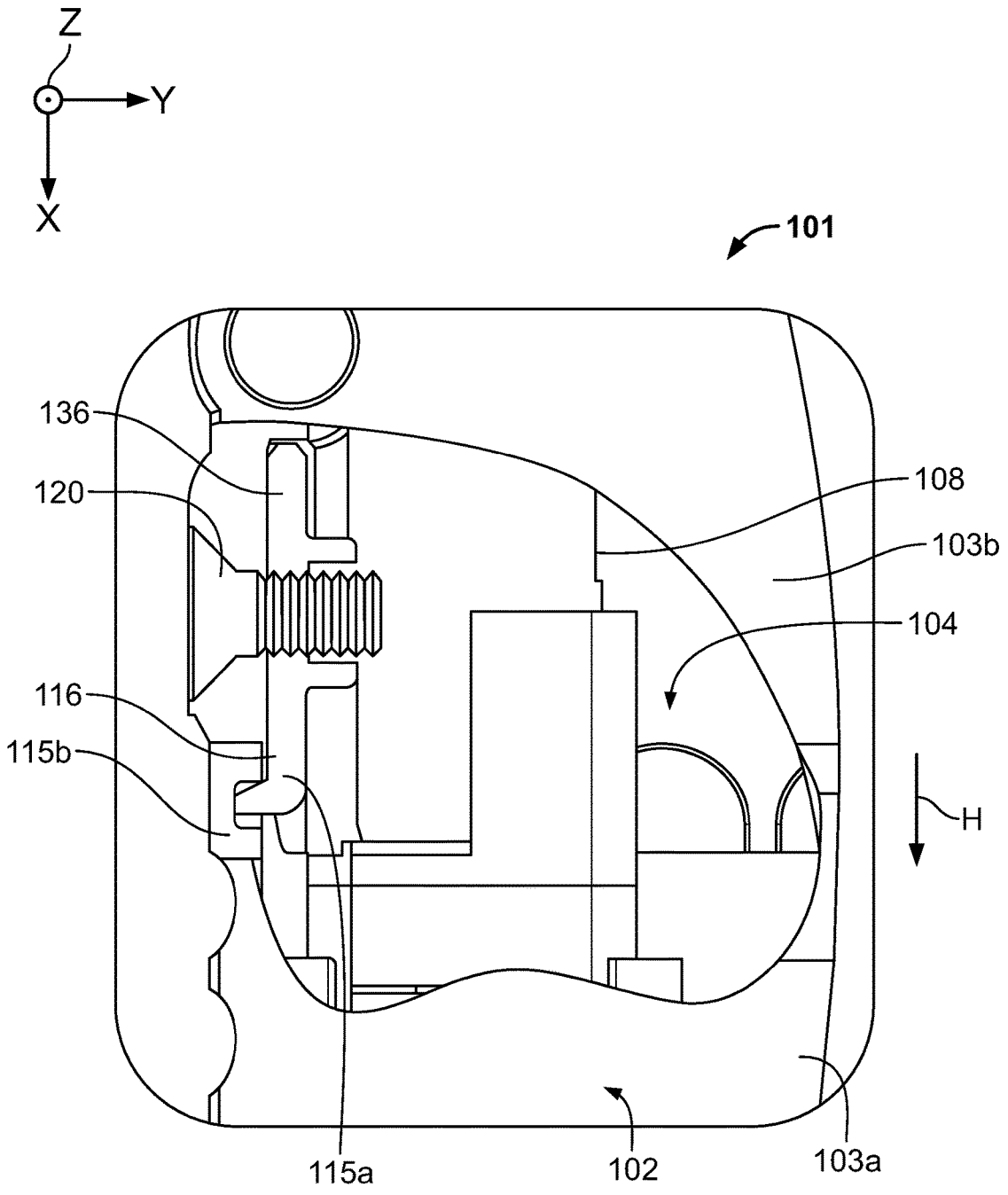
Fig. 9 (Prior Art)
FIG. 9 is a sectional view of a lock according to the prior art.

FIG. 8 also shows the connector 1 with the enclosure assembly 2 in the fully assembled state C. A tool 50 is inserted with its tip 51 through one of the actuation openings 27 and extends to the right of the actuation section 22 in the actuation direction J. The tool 50 may be a standard tool, like a screwdriver, for example. By exerting a lever force onto the lock 20 or pulling the lock 20 in a direction opposite to the securing direction K, the locking mechanism 10 may be transferred from the secured position S back to the locked position L. Afterwards, the locking element 10 may be transferred from the locked position L to the unlocked position U by exerting an unlocking force in a direction opposite to the actuation direction J onto the lock 20, in particular onto the actuation section 22 thereof at the handle 24. In the locked position L and unlocked position U, the lock 20 protrudes from the enclosure assembly 2 such that the two handling members 26 extend above the outer contour 28 for manual manipulation by an operator.

Advantageously, according to the enclosure assembly 2 for an electrical connector 1 of the present invention, the catch 15*a* is easily immobilized by the lock 20. The second housing body 3*b* is thereby easily attached to and secured to the first housing body 3*a*. The lock 20, furthermore, is held at the housing 3 such that it may not be lost. The lock 20 is easily accessible from outside the enclosure assembly 2, protrudes from the enclosure assembly 2 for manual manipulation between the locked position L and the unlocked position U, and is aligned with an outer contour 28 of the enclosure assembly 2 in the secured state S to protect the lock 20 from harmful influences such as mechanical impacts, dirt and/or moisture.

What is claimed is:

1. An enclosure assembly for an electrical connector, comprising:

a first housing body having a catch securing the first housing body to a portion of the electrical connector and a stop; and a lock having a post and an actuation section connected to the post, the lock being movable in an actuation direction between an unlocking position and a locking position in which the post prevents movement of the catch, the actuation section is slidely moved and being spaced apart from the stop so that the lock is allowed to be pivotable from the locking position into a secured position in which the post prevents movement of the catch and the actuation section abuts the stop and prevents movement of the lock in a direction counter to the actuation direction back to the unlocking position.

2. The enclosure assembly of claim 1, wherein the first housing body has an interior space.

3. The enclosure assembly of claim 2, wherein electrical components of the electrical connector are disposed in the interior space.

4. The enclosure assembly of claim 2, wherein the first housing body has a cable inlet extending from an exterior of the enclosure assembly to the interior space.

5. The enclosure assembly of claim 1, wherein the lock abuts the catch in the locking position.

6. The enclosure assembly of claim 1, wherein the lock is slidable within a lock passageway.

7. The enclosure assembly of claim 6, wherein the lock passageway is formed in part by the catch.

8. The enclosure assembly of claim 6, wherein the lock passageway is formed as a slot in which the lock is disposed.

9. The enclosure assembly of claim 6, wherein the lock passageway has an actuation opening open to an exterior of the enclosure assembly.

10. The enclosure assembly of claim 9, wherein the lock has a handle accessible from an exterior of the enclosure assembly through the actuation opening.

11. The enclosure assembly of claim 1, wherein the post is positioned between and abuts both the first housing body and the catch in the locking position.

12. The enclosure assembly of claim 1, wherein a spring resiliently connects the actuation section to the post.

13. The enclosure assembly of claim 1, wherein the lock is fully positioned within the enclosure assembly in the secured position.

14. The enclosure assembly of claim 13, wherein the lock protrudes from the enclosure assembly in the unlocking position.

15. The enclosure assembly of claim 1, wherein the portion of the electrical connector is a second housing body having a counter-catch engaging the catch.

16. The enclosure assembly of claim 1, wherein the portion of the electrical connector is a plug portion of the electrical connector.

17. The enclosure assembly of claim 1, wherein the catch and the lock are formed of a plastic material.

* * * * *